United States Patent [19]

Meguerdichian et al.

[11] Patent Number: 4,655,324

[45] Date of Patent: Apr. 7, 1987

[54] METHOD FOR PRIVATELY CONTROLLING AN ELEVATOR

[75] Inventors: Gary M. Meguerdichian, Waterbury; Robert E. Greenstien, Rocky Hill, both of Conn.

[73] Assignee: Otis Elevator Company, Farmington, Conn.

[21] Appl. No.: 778,833

[22] Filed: Sep. 23, 1985

[51] Int. Cl.[4] ..... B66B 1/46

[52] U.S. Cl. ..... 187/121; 340/20

[58] Field of Search ..... 187/29; 340/19, 20

[56] References Cited

U.S. PATENT DOCUMENTS

| | | | |
|---|---|---|---|
| 4,341,288 | 7/1982 | Bass | 187/29 R |
| 4,558,298 | 12/1985 | Kawai et al. | 187/29 R X |
| 4,594,570 | 6/1986 | Tweed, Jr. et al. | 340/20 X |

*Primary Examiner*—William M. Shoop, Jr.
*Assistant Examiner*—W. E. Duncanson, Jr.

[57] ABSTRACT

Elevator commands, such as car calls, are entered through a wireless, hand-held transmitter. A command is received and registered as if it were directly entered on the car-operating panel. Transmission of some calls is delayed after the call is entered on the transmitter.

11 Claims, 1 Drawing Figure

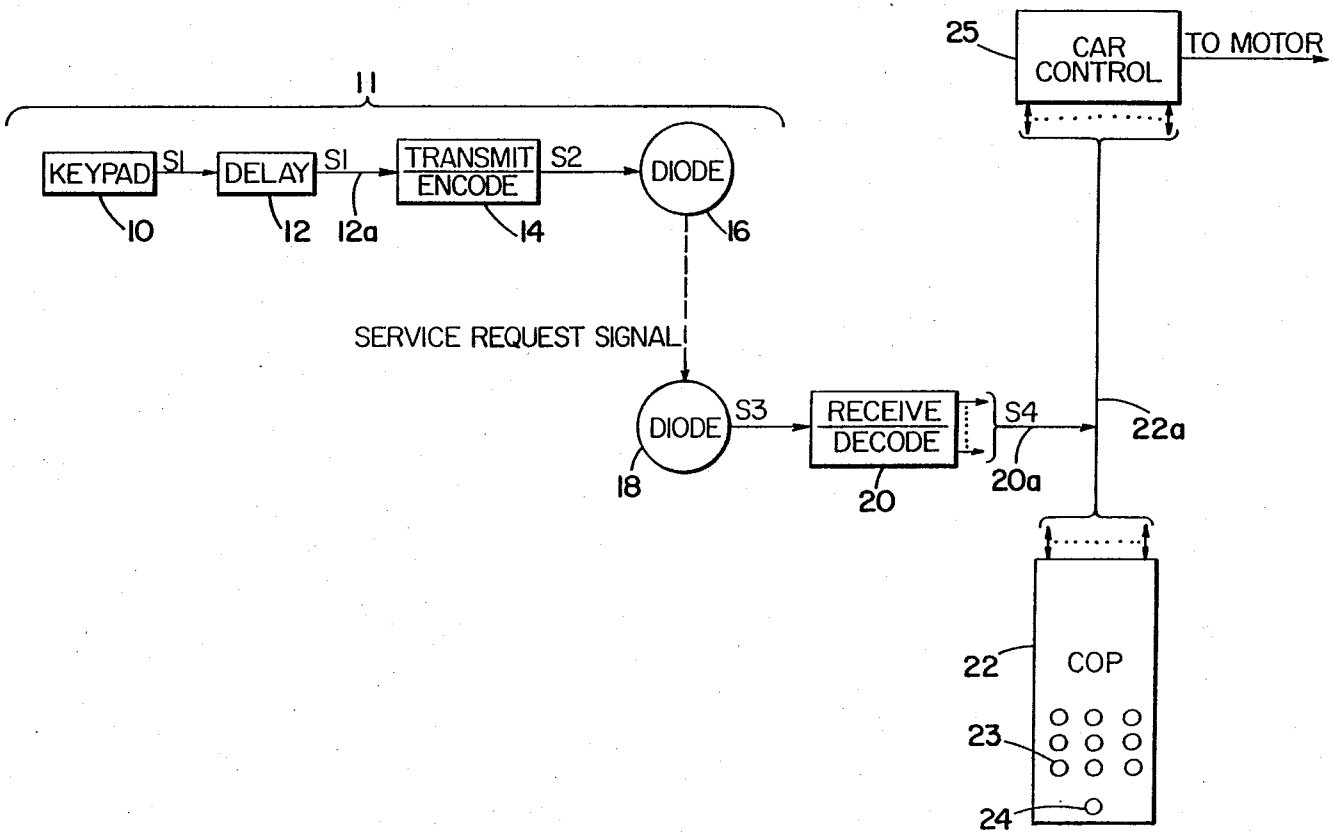
TO MOTOR
CAR CONTROL
25
22a
COP
22
23
24
S4
20a
RECEIVE DECODE
20
S3
DIODE
18
SERVICE REQUEST SIGNAL
DIODE
16
S2
TRANSMIT ENCODE
14
11
S1
12a
DELAY
12
S1
KEYPAD
10

METHOD FOR PRIVATELY CONTROLLING AN ELEVATOR

TECHNICAL FIELD

This invention relates to techniques by which passengers control operation of an elevator car, for example, enter car calls.

BACKGROUND ART

Current schemes provide only one way for entering car calls in waiting elevator cars and entering car calls to private or "secured" floors. To enter calls according to prior art schemes, a button, which is located on the car-operating panel in the elevator cab, is operated by the passenger. In some situations, a "secured" floor is accessed by operating a key switch or entering an access code by pressing a preset combination of car call buttons.

DISCLOSURE OF INVENTION

Among the objects of the present invention is to provide a method by which car calls may be entered for normal or security purposes without the car call buttons. A particular objective is to provide a method by which handicapped passengers may enter the car call from any location in the car. It is also an object to allow those having access to secured floors to enter car calls from any location in the car.

According to the present invention, a passenger enters a car call or other car request by operating a hand-held, wireless, concealable transmitter. The transmitter contains one or more buttons, each of which identifies a particular floor. They may be used in combination to gain access to a secured floor or command other functions, such as an emergency stop or emergency silent call. The passenger carries the remote transmitter, for example, in his pocket, and simply enters the correct call or other function by operating the keys. A receiver antenna or sensor is located in the cab to receive the transmitted command, which is directed to the car controller, like the same command entered on the car buttons.

According to one aspect of the invention, the transmitter sends out an infrared signal, which is received by an infrared receiver that is associated with the car-operating panel. For example, the infrared detectors may be located on the bottom of the car-operating panel, and the receiver may be included in the circuitry associated with the car-operating panel. Upon receipt of the signal from the remote control transmitter, the receiver enters the correct car call over the lines used with the car call button or security key switch on the car-operating panel. According to another aspect of the invention, a passenger may enter the service request on the transmitter before he enters the cab, and the command is transmitted automatically after he enters the cab.

BRIEF DESCRIPTION OF THE DRAWING

The drawing is a functional block diagram of an elevator control system emboding the invention.

BEST MODE FOR CARRYING OUT THE INVENTION

To implement the method of the present invention, a hand-held, remote control transmitter contains one or more buttons to identify, either directly or through a code, a floor or special car operation (such as an emergency stop or silent emergency call). Car calls from one to ninty-nine floors, which covers virtually all buildings, may be made with a single ten-digit keyboard with keys from zero to nine. It is possible for a passenger carrying this remote control device to enter car calls in other buildings by making the transmitters and receivers in different systems compatible. Preferably, the sensitivity of the receiver is limited so that it can only detect entry of calls from transmitters that are at the threshold or within the confines of the elevator cab.

Devices for transmitting such information in the form of infrared signals are well known. They have been used for some time in remote control operation of television and some other home appliances. One device is the Model U-327M and U-328M, monolithic integrated circuits available from Telefunken A.G. Using these devices, the transmitter includes an infrared diode that is energized, transmitting infrared energy, which is detected by an infrared detector associated with a receiver. The signal is encoded (typically through a binary thirteen-digit code by the actuation of one or more buttons on a ten-digit keyboard). The receiving diodes, of which there are typically two, may be located at the lower portion of the car-operating panel (COP), in other words, pointing downward towards the floor, to obtain the directional characteristics that eliminate receiving commands transmitted from outside the cab.

This method for commanding car functions may be easily added in existing elevators. The receiver may be located in the car-operating panel. Semiconductor switches may be operated by the receiver for providing parallel (simulated) operation of the car call buttons. If computer control is utilized in the elevator system, the received information may be transmitted directly to the dispatching computer over the data bus.

The technique for entering car calls provided by the present method may also be used to enter car calls in a system in which car calls are directly entered from the lobby. Passengers approaching the lobby or in it can transmit (through their individual remote control transmitters) a signal identifying the floor to which they wish to go. This call request is received by a remote control receiver in the lobby, and the call would be assigned to one of the available cars, just as it would be if the passenger had entered the car identification at a station somewhere in the lobby.

Transmission of the call (or other request) may be time delayed until a passenger enters the cab, eliminating a need to operate the keyboard around other people in the cab. A passenger can operate the keyboard in the lobby if this particular technique is used, and the call will be automatically entered.

The drawing shows such a system. A service request is made on a keypad 10, which is part of a hand-held transmitter 11. The output S1 is provided to a delay 12, and, after a preset delay (e.g. 30 seconds), applied on the delay output line **12*a* to an infrared transmitter encoder 14, such as the Model U-327M, producing an encoded signal S2 which activates an infrared diode 16 which produces an encoded infrared Service Request signal. That signal is received by an infrared diode 18 which provides a signal S3, the replicate of S2, to a receiver decoder 20, Model U-238M. An output signal S4 is provided. The signal S4 identifies the service request in the format used by a COP 22, on which the same request may be made through buttons 23 or a switch 24**. A data bus 22*a* connects the COP and a car control 25. The signal S4 is applied to the bus. The car control receives the signal S4 and processes it as if it were provided from the COP directly. In response to the signal S4, the control 25 may illuminate a button on the COP depending on the service associated with the signal S4.

While the invention has been explained in the context of entering secured and unsecured and emergency calls, the invention may also be employed to control other elevator operations through separate keys on the hand-held transmitter or a combination of the car call keys. Other uses for the invention in elevators will be obvious for one skilled in the design of elevator systems from the foregoing discussion and explanation of the invention.

We claim:

1. A method by which elevator passengers control operation of an elevator car controlled by a car control system and having a car-operating panel by which passengers enter car control requests on buttons and switches, characterized by the steps:

entering a car command on a hand-held, wireless transmitting device to cause the transmission of a coded command signal;

receiving the coded command signal through a sensor associated with the elevator cab;

decoding the received coded command signal; and registering the car command with the car control system.

2. A method according to claim 1, characterized in that the car command is transmitted as digitally encoded infrared signal transmitted from the transmitter to the receiver.

3. The invention according to claim 2, characterized in that a car command is entered by actuating one of a plurality of coded functional buttons on the transmitter.

4. A method according to claim 1 or 3, characterized in that some car commands are entered by operating a combination of the buttons and one car command is an emergency signal.

5. A method according to claim 1, characterized in that the transmission of the coded command signal is delayed after the car command is entered on the transmitter.

6. A method according to claim 1, characterized in that the sensor is located in the cab.

7. Apparatus for making elevator car service requests, characterized by:

an elevator car controller;

a car-operating panel for making a service request to the controller;

a wireless transmitter that is transportable by passengers and that includes a key that is operable by a passenger for transmitting the service request;

a receiver associated with the car for receiving the service requests transmitted by the transmitter and making the service request to the controller.

8. An apparatus according to claim 7, characterized in that the transmitter comprises means for delaying transmission of the service request for a preset time interval after the key is operated by the passenger.

9. An apparatus according to claim 7 or 8, characterized in that the transmitter includes a plurality of keys that are operated to enter the service request and at least one of the keys is operable to indicate an emergency.

10. An apparatus according to claim 7, characterized in that the receiver includes a sensor in the elevator cab to receive the transmitted service request.

11. An apparatus according to claim 10, characterized in that the sensor is located on a car operating panel.

* * * * *